United States Patent [19]

Williams

[11] 4,082,328

[45] Apr. 4, 1978

[54] APPARATUS FOR JOINING UNDRAWN YARNS

[75] Inventor: Peter Geoffrey Williams, Mitcheldean, England

[73] Assignee: Monsanto Company, Decatur, Ala.

[21] Appl. No.: 819,792

[22] Filed: Jul. 28, 1977

[30] Foreign Application Priority Data

Aug. 6, 1976 United Kingdom ..... 32869/76

[51] Int. Cl.[2] ..... A01D 59/04; D03J 1/18; D04G 5/00

[52] U.S. Cl. ..... 289/2; 28/211; 242/35.6 R

[58] Field of Search ..... 289/1.2, 1.5, 2, 3, 289/4, 18; 28/211; 242/35.6 R

[56] References Cited

U.S. PATENT DOCUMENTS

| | | | |
|---|---|---|---|
| 2,977,144 | 3/1961 | Gegenschatz et al. | 289/2 X |
| 3,813,742 | 6/1974 | Bar | 289/3 |
| 3,966,241 | 6/1976 | Jones et al. | 289/1.2 |
| 3,990,732 | 11/1976 | Reichert | 28/211 X |

*Primary Examiner*—Louis K. Rimrodt
*Attorney, Agent, or Firm*—Robert L. Broad, Jr.

[57] ABSTRACT

An apparatus for tying a knot in the ends of a pair of filaments or yarns comprising a hollow element having an open end and an opening adjacent to the open end, the opening and the open end being connected by a slot. A second element movable relative to the first element is provided with a projection for engaging the ends of the pair of filaments or yarns and wrapping these ends around the hollow element in such a manner that a first wrap lies over the slot and a second wrap lies over the opening. A first hook movably mounted on the second element is provided for engaging the second wrap lying across the opening and pulling it out through the open end of the first element to form a knot in the filaments, while a second hook is provided for engaging that portion of the yarn extending across the slot and moving it to a position adjacent to a filament clamp holding the filaments. The first hook is adapted to clamp the ends of the filaments and apply tension, when manually moved, to tighten the knot on the second hook.

6 Claims, 10 Drawing Figures

APPARATUS FOR JOINING UNDRAWN YARNS

BACKGROUND OF THE INVENTION a. Field of the Invention

This invention relates to apparatus for joining yarns or filaments.

b. Description of the Prior Art

When operating textile machinery involving the handling of running yarns, it is often necessary to join two ends of yarns together. For example, when changing supply packages of yarn it is desirable, in order to avoid restringing the machine, to join the end of one package to the beginning of the next. Several ways of doing this have been proposed but it is most usual to knot the two ends of the yarn together, a method which has normally been successful where the yarns were in a drawn state. With undrawn yarns, however, difficulties arise when an attempt is made to apply sufficient tension to the knot in order to make it secure, because the application of such tension merely causes the yarn to be drawn. The resulting presence of a few centimeters of drawn yarn, in a yarn that is on the whole undrawn, causes problems when the yarn is later processed. If the further processing includes a drawing step, the few centimeters of drawn yarn close to the knot may become overdrawn or may even break. Even if the yarn does not break, the overdrawn portion of the yarn presents a different appearance when dyed from the appearance of yarn which has been drawn only to the proper extent. It also has a lower tensile strength and when textured has inferior crimped characteristics.

It has been proposed to draw the ends of two undrawn yarns and join them by a knot so that there is substantially no undrawn yarn forming the knot and there is substantially no drawn yarn outside the knot. The present invention is concerned with an apparatus for knotting together two undrawn yarns so as to form a joint of this kind.

SUMMARY OF THE INVENTION

An apparatus for tying a knot in the ends of a pair of filaments comprising a hollow element having an open end and an opening adjacent to the open end, the opening and the open end being interconnected by a slot. A second element movable relative to the first element is provided with a projection for engaging the ends of the pair of filaments and wrapping these ends around the hollow element in such a manner that a first wrap lies over the slot and a second wrap lies over the opening. A first hook movably mounted on the second element is provided for engaging the second wrap lying across the opening and pulling it out through the open end of the first element to form a knot in the filaments, while a second hook is provided for engaging that portion of the yarn extending across the slot and moving it to a position adjacent to a filament clamp holding the filaments. The first hook is adapted to clamped ends of the filaments and apply tension, when manually moved, to tighten the knot on the second hook.

DETAILED DESCRIPTION OF THE INVENTION

Figure 1:
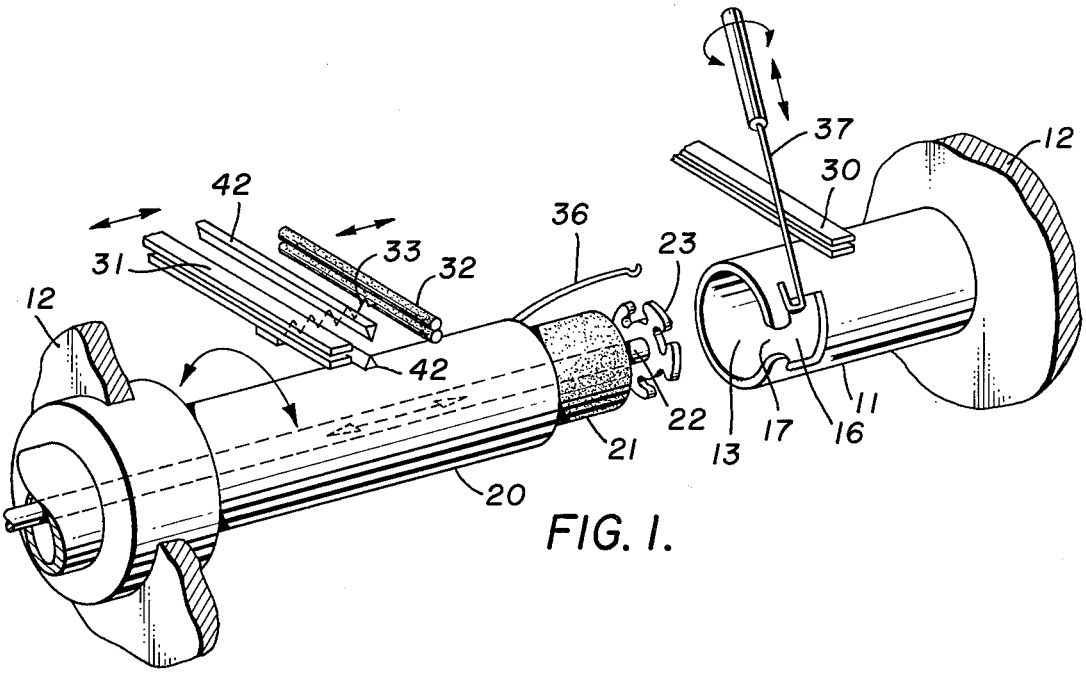
FIG. 1 is a fragmentary perspective view of the apparatus of the present invention showing the relationship of the various elements making up the apparatus.

Referring now in detail to FIG. 1, there is shown a hollow first element 11 secured to a frame 12 and having an open end 13. The element 11, which is in the form of a tube, is provided with an opening 16 adjacent to the open end and connected to the open end by a slot 17. It will be noted that the opening 16 has a substantially greater width in a circumferential direction than does the slot 17.

A tubular second element 20, mounted on the frame 12 for both rotating and sliding movement is positioned coaxially with the first element 11. The mounting of the second element 20 is such that this element can be manually moved toward or away from the first element 11 and can be rotated about its axis. The second element 20 is provided with a rubber bushing 21 through which a rod 22 extends, the rod 22 being manually movable in the bushing 21. A cruciform hook 23 is secured to the rod 22 for the purpose of forming a knot in the yarn and clamping the ends of filaments or yarns 26 between the hook 23 and the rubber bushing 21 as will be described hereinafter.

The apparatus is provided with a first pair of clamps 30 positioned adjacent to the first element 11 and a second pair of clamps 31 positioned adjacent to the second element 20. The purpose of the clamps 30 and 31 is to hold the ends of the yarns or filaments 26 in position in order that these ends may be tied into a knot. A third pair of clamps 32 is positioned between the clamps 30 and the clamps 31 and is connected to one of the pair of clamps 31 by a spring 33. A pair of manually operated, cooperating knives 42 are positioned adjacent to the pair of clamps 31 to sever the filaments at a point adjacent to the clamps 31. The spring 33 is provided for absorbing the recoil energy of the filaments when the cut is made. The clamps 32 are made of a resilient material which will not firmly hold the filaments but will allow the filaments to slip through this pair of clamps as the knot is being tied in the filaments.

Figure 2:
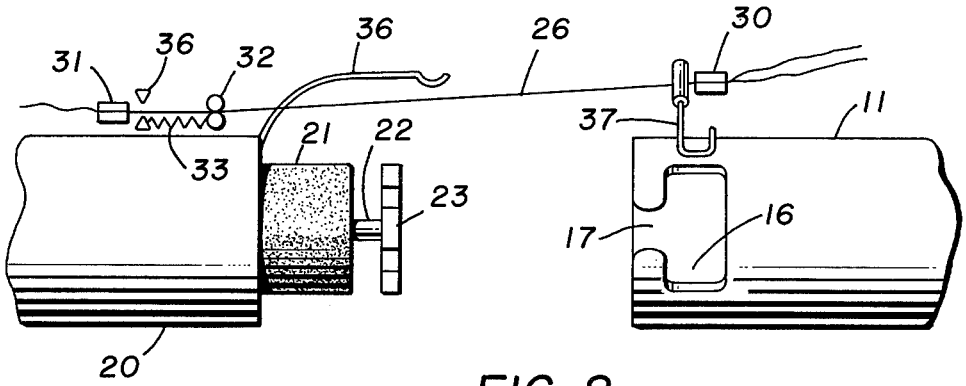
FIGS. 2–10 are side views of the apparatus showing the positioning of the various elements of the apparatus during the successive steps of forming a knot in the filaments.
Figure 3:
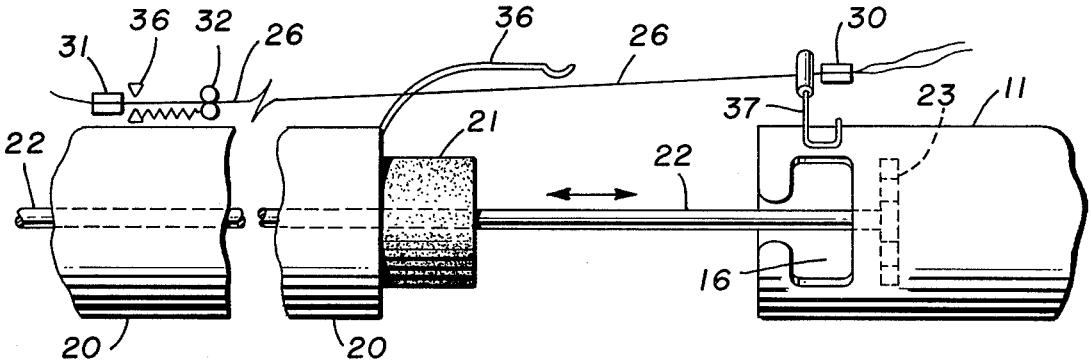

FIG. 2 shows the filaments 26 held in the clamps 30, 31 and 32 prior to the sequence of steps which will form a knot in the ends of the filaments 26. FIG. 3 shows the next step in the sequence, where the rod 22 is moved to advance the cruciform hook 23 into position in the hollow element 11. The knives 42 are then manually urged together to sever the filaments at a point adjacent to the pair of clamps 31. The resilient clamps 32 will continue to hold the ends of the filaments until these ends are pulled out of this pair of clamps during the knot tying sequence.

Figure 4:
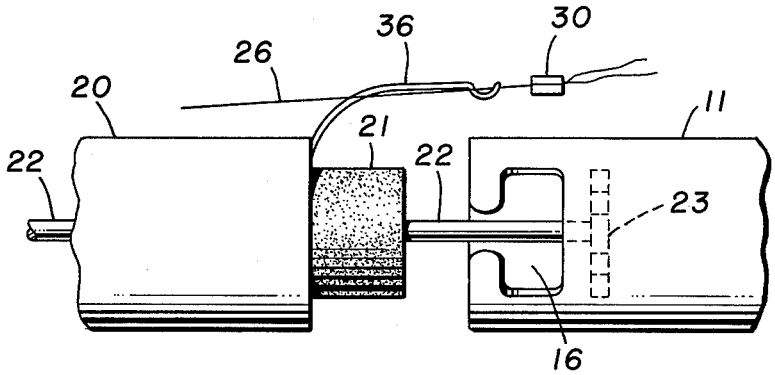
Figure 5:
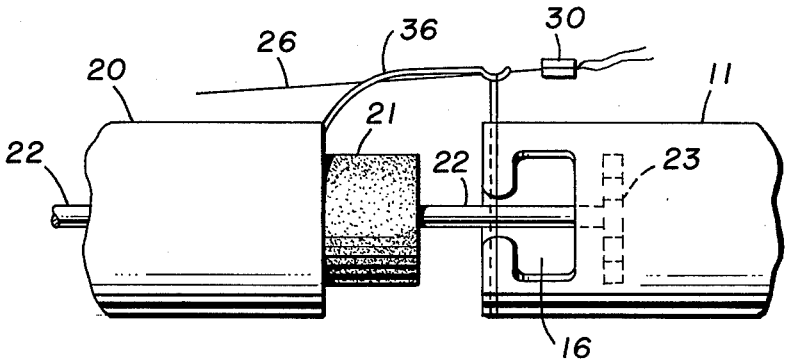

The element 20 is then moved toward element 11 into the position shown in FIG. 4 to position a projecting portion 36 secured to the element 20 in position to engage the clamped filaments 26 as shown in FIG. 4.

The element 20 is then manually rotated one turn to make a first wrap of the filaments 26 on the element 11. It will be noted that this wrap lies substantially over the slot 17 in the end of the tubular element 11.

Figure 6:
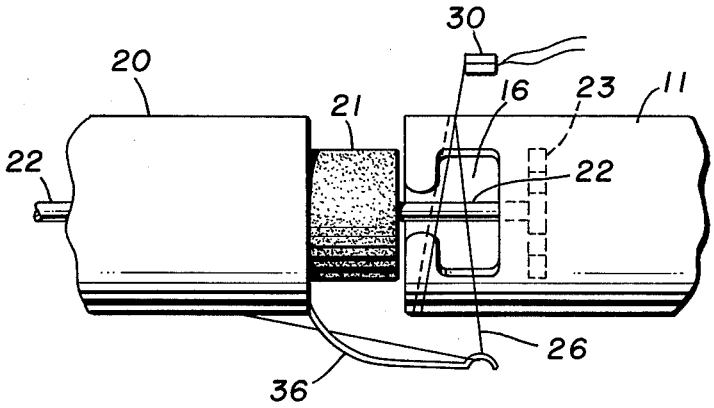

The element 20 is then manually moved closer to the element 10 and rotated through another 270° to form a second wrap on the element 11 as shown in FIG. 6. It will be noted that this second wrap lies across the opening 16 in the element 11. During these wrapping steps the ends of the filaments 26 will slip through the resilient clamps 32 as filament length is taken up by the wraps.

The rod 22 is then manually moved to withdraw the hook 23 from inside the element 11 to thereby engage the second wrap lying across the opening 16 and pull the free ends of the filaments out through the open end of the element 11 into a position where the hook 23 is in engagement with the end of the rubber bushing 21 to thereby clamp the free ends of the filaments. This forms a large, open knot in the filaments.

A second hook 37 (FIG. 1 and FIGS. 7–10) which is mounted on the frame 12 for both rotating and sliding movement is provided for engaging that portion of the first wrap of filaments lying across the slot 17 to support the knot which has been formed in the filaments. After the filaments have been caught by the hook 37, the knot is slipped off the end of the element 11 and the hook 37 is then manually removed to a position adjacent to the clamps 30 as illustrated in FIG. 8. At this point a large, loose knot has been formed in the filaments 26, with the knot being held by the hook 37 in close proximity to the clamps 8.

Figure 9:
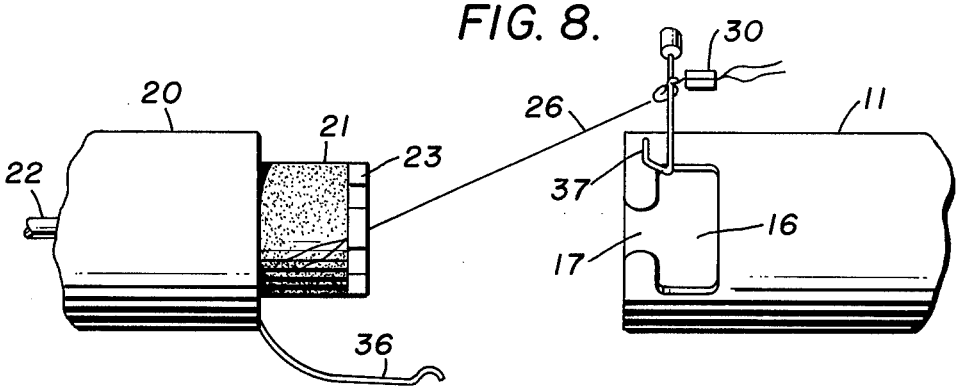
Figure 10:
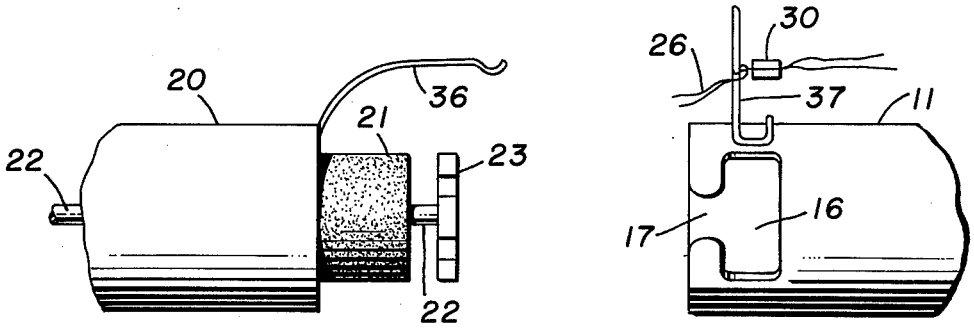

The element 20 and the hook 23 are next manually moved to the right to tighten the knot on the hook 37 as illustrated in FIG. 9. The free ends of the filaments extending from the knot on the hook 37 to a clamped position between the hook 23 and the rubber bushing 21 may now be severed as illustrated in FIG. 10 and the completed, tightened knot slipped off the hook 37. The tightened knot will have substantially no undrawn yarn making up the knot and there will be substantially no drawn yarn outside the knot.

In operation, the yarns or filaments 26 will be clamped as shown in FIG. 2 and the element 20 and the hook 23 will be moved into the positions shown in FIG. 4. The element 20 will then be manually rotated through one complete turn and then moved closer to the element 11 and again moved manually through at least about 270°. This will put almost two complete wraps of the filaments on the element 11, with the first wrap lying across the slot 17 and the second wrap lying across the opening 16 as illustrated in FIG. 6.

Figure 7:
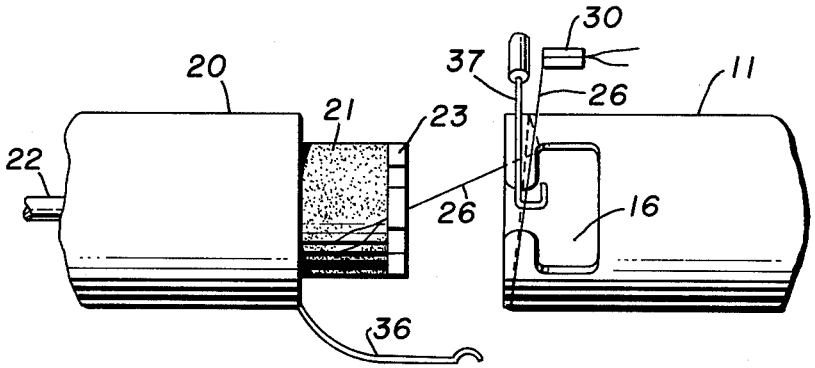
Figure 8:
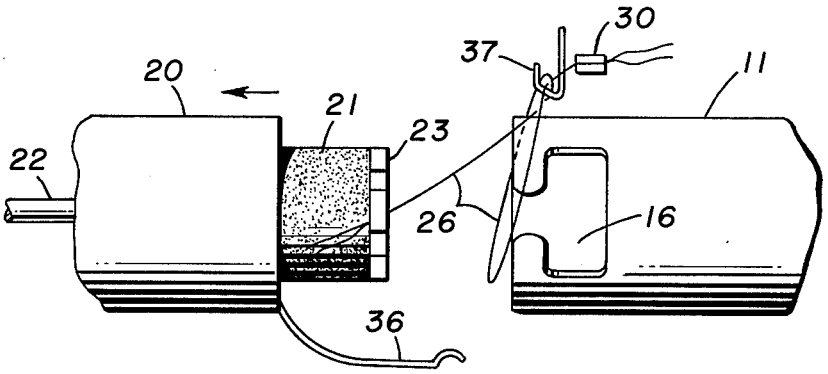

The hook 23 is then withdrawn manually from inside the element 11 into the position shown in FIG. 7, the hook engaging the filaments lying across the opening 16 and pulling these filaments through the wrap lying over the slot 17 to form a knot in the filaments. The hook 37 is then manually moved into the position shown in FIG. 7 to engage that wrap of filaments lying across the slot 17.

The loose knot is then manually slipped off the end of the element 11 and the hook 37 moved to the position shown in FIG. 8 to support the knot at a point adjacent to the clamps 30. The element 11 and the hook 23 are then manually moved further away from the element 11 to tighten the knot on the hook 37. The free ends of the filaments are then severed adjacent to the hook 37, whereupon the completed, tightened knot may be slipped off this hook.

What is claimed is:

1. Apparatus for tying a knot in a pair of filaments, comprising:

a. a hollow first element having an open end and an opening adjacent to said open end, said opening being connected to said open end by a slot, said opening being larger in a circumferential direction than the slot so that a filament lying over the opening under tension will extend further into the hollow element than will a filament lying over the slot, b. a second element having a projecting portion for engaging the ends of a pair of filaments and wrapping said ends around the first element, said first and second elements being movable relative to each other, c. means adjacent to the first and second element for clamping and holding the ends of the pair of filaments in position to be engaged by said projection and wound around the first element, and d. hook means movably mounted on the second element for engaging that portion of the filaments lying across the opening and pulling said portions out of the hollow element to form a knot in the filaments.

2. The apparatus of claim 1 wherein a hook is provided for engaging that portion of the filaments lying across the slot and moving said portion to the vicinity of the clamping means in such a manner that further tension on the ends of the filaments tightens the knot at the vicinity of said clamping means.

3. The apparatus of claim 2 wherein the first element is stationary and the hook means is movable to enter said first element to engage the filaments.

4. The apparatus of claim 3 wherein the second element is mounted for reciprocating movement toward and away from the first element and rotative movement to carry the projecting portion around said first element.

5. The apparatus of claim 4 wherein the hook is mounted for both reciprocating and rotative movement.

6. An apparatus for joining a pair of filaments, comprising:

a. a frame, b. a tubular first element mounted on the frame and having an open end, said element having an opening adjacent to the open end and interconnected to said open end by a slot, said opening having a greater circumferential dimension than said slot, c. a tubular second element mounted on a frame for reciprocating movement toward and away from the first element and for rotating movement about the axis of the first element, said second element having a projecting portion for engaging the ends of the filaments and wrapping said ends around the first element, d. a first pair of clamps positioned adjacent to the first element for holding the filaments, e. a second pair of clamps positioned adjacent to the second element for holding the ends of the filaments, said first and second pairs of clamps holding the filaments in position to be engaged by the projecting portion as the second element is rotated, f. a cutter positioned adjacent to the second pair of clamps for severing the filaments, g. a third pair of resiliently mounted clamps positioned between the first pair of clamps and the second pair of clamps for holding the ends of the filaments after these ends have been cut, h. a first hook mounted on the second element and adapted to be moved into the first element for engaging the filaments extending across the opening in the first element, said hook being adapted to pull filaments out of the first element through the open end thereof to form a knot and clamping said filaments between the hook and the second element, i. a second hook positioned adjacent to the first element and being mounted for rotative movement to pick up the filaments lying across the slot in the first element, said second hook also being mounted for reciprocating movement for moving the knot in the yarn to a position adjacent to the first set of clamps.

* * * * *